US008224001B1

(12) United States Patent
Waller

(10) Patent No.: US 8,224,001 B1
(45) Date of Patent: Jul. 17, 2012

(54) LINE ARRAY LOUDSPEAKER

(76) Inventor: Jon J. Waller, Waterford, MI (US)

( * ) Notice: Subject to any disclaimer, the term of this patent is extended or adjusted under 35 U.S.C. 154(b) by 1238 days.

(21) Appl. No.: 12/004,770

(22) Filed: Dec. 21, 2007

(51) Int. Cl.
*H04R 5/02* (2006.01)
*H04R 1/02* (2006.01)

(52) U.S. Cl. ..... 381/304; 381/305; 381/89; 381/332; 381/336; 381/395; 381/184; 381/186; 181/145; 181/147; 181/150; 181/152; 181/189; 181/199

(58) Field of Classification Search ..... 381/303, 381/304, 305, 59, 64, 89, 332, 336, 96, 395, 381/335, 184, 186; 181/145, 147, 150, 152, 181/163, 189, 190, 199
See application file for complete search history.

(56) References Cited

U.S. PATENT DOCUMENTS

| | | | | |
|---|---|---|---|---|
| 5,163,167 | A | 11/1992 | Heil | |
| 6,112,847 | A | 9/2000 | Lehman | |
| 6,173,064 | B1 * | 1/2001 | Anagnos | 381/353 |
| D450,778 | S | 11/2001 | Engebretson | |
| 6,394,223 | B1 * | 5/2002 | Lehman | 181/152 |
| D500,025 | S | 12/2004 | Vincenot et al. | |
| 7,418,104 | B2 * | 8/2008 | Spinale | 381/87 |
| 2009/0175476 | A1 * | 7/2009 | Bottum | 381/335 |
| 2010/0119089 | A1 * | 5/2010 | Tracy | 381/184 |

* cited by examiner

*Primary Examiner* — Ngan Ngo
(74) *Attorney, Agent, or Firm* — Bagle Gotwals

(57) ABSTRACT

A line array speaker provides highly uniform frequency response throughout a wide listening field, while also reducing distortion and improving fidelity, clarity, and output level. In a symmetrical embodiment, central apertures are straddled by a sequential pairs of sets of apertures. The straddling pairs emit frequencies in the next lower frequency band relative to the frequency band of the immediately preceding frequency band apertures. In an asymmetrical embodiment, sequential frequency bands are emitted by adjacent sets of apertures rather than straddling pairs of sets of apertures. Each of the apertures may be a loudspeaker cone, one or more straight slots, one or more arbitrarily curved slots, one or more arbitrarily angled slots, one or more holes or the mouth of a horn. The speaker may have a front baffle which is a flat panel or multiple facets arranged in one or multiple recesses across a front of the speaker.

4 Claims, 4 Drawing Sheets

FIG. 1A
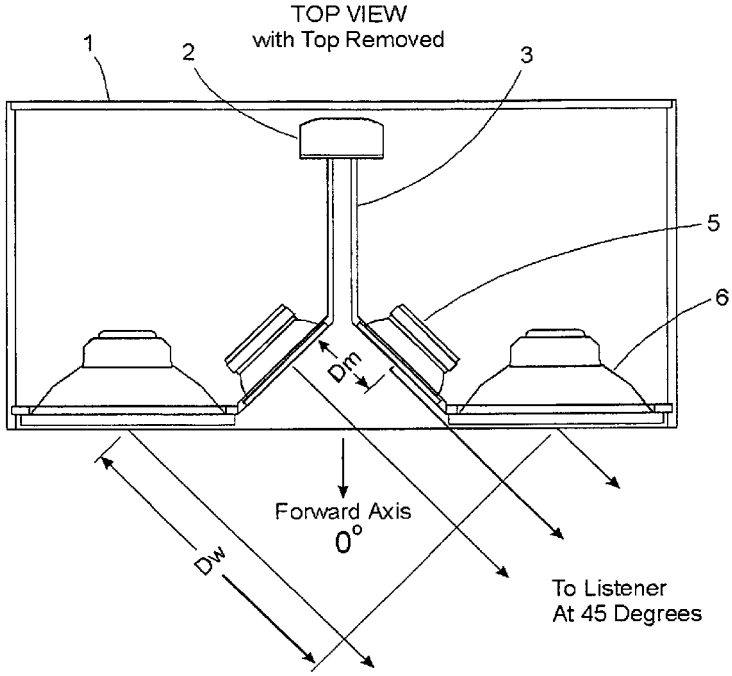
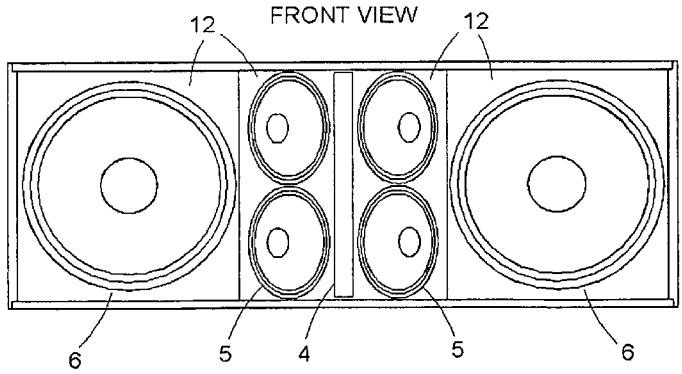
FIG. 1B
PRIOR ART

FIG. 2A
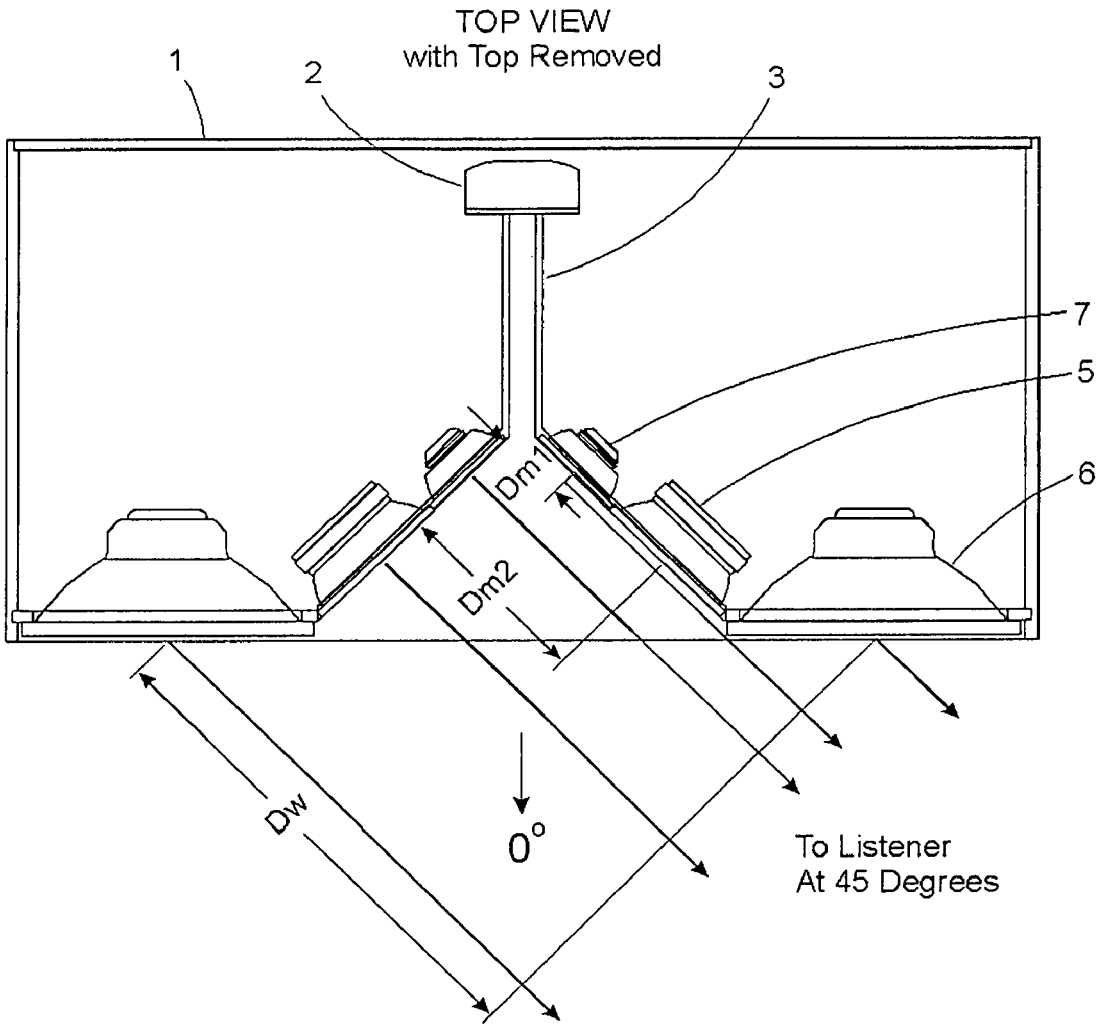
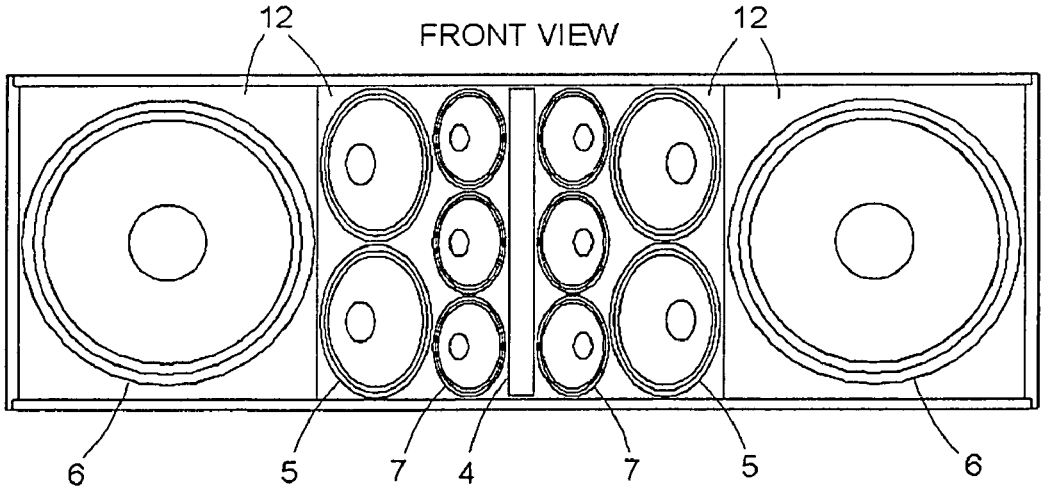
FIG. 2B

FIG. 3A
TOP VIEW
with Top Removed
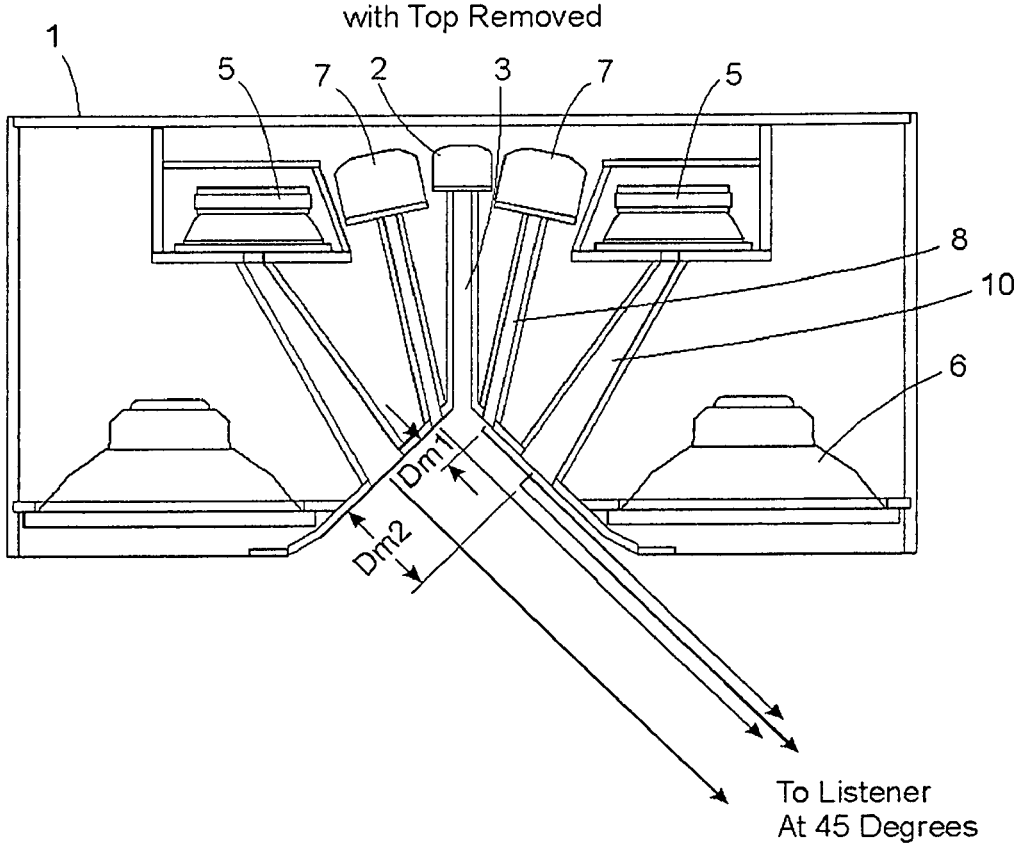
FRONT VIEW
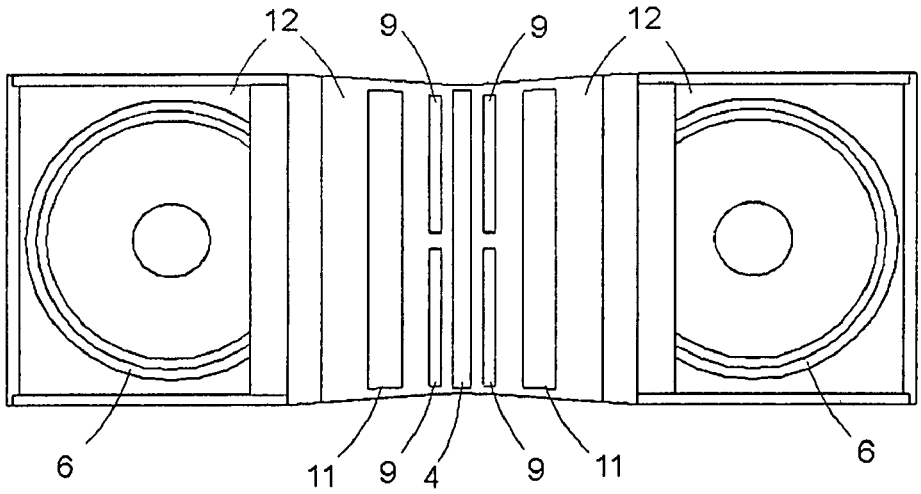
FIG. 3B

TOP VIEW
with Top Removed

FRONT VIEW

LINE ARRAY LOUDSPEAKER

BACKGROUND OF THE INVENTION

The present invention relates generally to high power loudspeaker systems, and more particularly to line array speaker configurations.

To achieve desired high levels of sound pressure level in a large space with low distortion and wide bandwidth, it has long been recognized that multiple, multi-way loudspeaker boxes are required. The multiple sources associated with multiple boxes creates problems with wave interferences at different frequencies and different locations throughout the intended listening area. This intended listening area can typically cover angular dimensions of 60 degrees vertically by 90 degrees horizontally. These interferences reduce the fidelity and clarity of the sound, particularly at larger angles from the array.

A major leap forward in the solution to this problem was the L'Acoustics VDOSC system. It consists of a single vertical stack of boxes, each of wide horizontal dispersion and progressively narrower vertical dispersion as frequency increases. The system is expandable by adding boxes, and adaptable to different venues by virtue of the adjustable angles between the boxes. The essential enabling technology for this system is disclosed in U.S. Pat. No. 5,163,167 issued to Christian Heil on Nov. 10, 1992. This patent discloses the high-frequency waveguide (horn) used in the implementation, which generates an approximately cylindrical wave front at high frequencies from a conventional high frequency compression driver, thereby achieving a much more uniform vertical coverage at higher frequencies and higher SPL than previously possible throughout a large audience area.

The VDOSC system is a three-way, or three frequency band, system with a horizontally symmetric driver layout, as represented in FIG. 1. As such, it contains compromises that limit it's ability to achieve the most uniform frequency response possible over the intended 90 degree horizontal coverage, and to do so with the widest possible high frequency bandwidth and the highest acoustic power levels. It contains a vertically oriented pair of DOSC high frequency waveguides centrally located, which are then flanked on either side by seven inch direct radiating cone midrange drivers, two per side, which are then flanked by fifteen inch direct radiating cone woofers.

The horizontal spacing between these drivers sets an upper frequency limit to their usefulness at a particular horizontal listening angle. If one's goal is to limit the attenuation due to interference of the two sources to a maximum of 3 dB at the upper crossover frequency, then the path difference between each source and the listener must not exceed ¼ wavelength at this frequency. To minimize this path difference, and thereby maximize the crossover frequency from the midrange to the high frequency drivers, the midrange drivers are mounted in a V configuration. Even with this configuration, at 45 degrees off axis, which is the limit of the intended coverage area, the differential path length in the midrange is approximately 5 inches, which results in a 3 dB loss at approximately 680 Hz, with higher losses above that. The ultimate losses at higher frequencies are somewhat mitigated by the directivity of the midrange cone that is angled at 90 degrees with respect to this listening position, but at 1 KHz, a 7-inch speaker (6 inch cone diameter) still has considerable output at this angle. Anyway, if the output of the highly angled, or cross-fired, cone were to drop to zero at higher frequencies, the combined output of the two sources would still be 6 dB down with respect to lower frequencies. If one attempts to reduce this midrange dip by using smaller diameter midrange drivers, thereby reducing the differential path length, the midrange sensitivity would decrease, and the capability of the drivers to handle the lowest frequencies within the midrange band would diminish due to higher cone excursions, the result being lower output and higher distortion would result, or the lower crossover point between the midranges and woofers would need to be increased. But this would result in a greater dip in the frequency response at this lower crossover point for off-axis listeners, due to the differential path length between the widely spaced woofers becoming larger as a function of this decreased wavelength at the top of their operating band.

The crossover frequency from the midrange cones to the high frequency drivers is approximately 1.5 KHz. Note that this is a full octave above where the differential path between the midranges at 45 degrees off axis results in a ¼ wavelength phase shift, i.e., the differential path between the midranges is a full ½ wavelength at this angle and frequency. If this crossover frequency were lower, the high frequency driver would distort more severely, and even be subject to failure due to the increased power applied to it as a result of the increased bandwidth signal. Any higher, and the reduction in midrange at large off-axis angles would be even more severe. Even with this crossover frequency, the use of what is known as a 'large format' high frequency driver is required. These drivers have a 3-inch voice coil and diaphragm (or larger), which allows them to be used with crossover frequencies of less than 2 Khz, in terms of their low frequency response and power handling. This is in comparison to a 'small format' high frequency driver, with voice coil and diaphragm sizes of 2 inches or less, and therefore higher frequency response roll off points and lower power handling ability.

But this large format results in very poor high frequency response above 10 KHz due to multiple causes. First, their relatively large moving mass results in a low 'mass-roll off' frequency, above which the response of the driver falls off. A second cause is due to the presence of multiple, different length, acoustic paths from the driver diaphragm, through the phase plug, and into the horn throat. These are also present in small-format drivers, but in a large format driver, the distances are greater, so the difference in path lengths is greater, the result being that large format drivers typically have severe dips in their response above 10 KHz. A third cause is due to diaphragm breakup, where above a certain frequency, often 12 KHz, the diaphragm ceases to move as a single piston, but rather more like a wet noodle, causing further peaks and dips in the frequency response. In a small format driver, this breakup frequency is typically much higher.

Finally, an often overlooked cause for poor high frequency response when large format drivers are used is throat size. Large format high frequency drivers have throat diameters from 1.4 inches up to 2.0 inches. When coupled to a constant-directivity horn or waveguide, this dictates a diffraction slot width of a similar size. But such wide slots will severely beam the frequencies with wavelengths of similar or smaller dimensions, with the result that at horizontal angles of greater than 25 or 30 degrees, the highest octave will be further attenuated.

One more phenomenon which affects all line arrays will result in even further HF attenuation. This comes about because with line arrays, the multitude of high frequency emitters, and the small vertical angles between adjacent emitters, results in pattern overlap between a number of drivers. This is actually desired, as it allows for the summation of high frequency acoustic energy from multiple drivers, resulting in higher output levels. But this summation is not perfect, as the path lengths from the listening position to the multiple drivers are not equal, especially if the line is curved, as is typical to achieve the desired vertical coverage. This differing path length becomes a larger fraction of the wavelength as frequency is increased, resulting in less in-phase summation, and therefore more relative attenuation as frequency is increased.

As a result of all these factors, it is common to have to apply a 10 dB or more boost to the high frequency level above 10 KHz, which corresponds to a factor of 10 increase in applied power! This further compounds the effects of diaphragm breakup and power compression (loss of output due to heating in the voice coil and increasing it's resistance to current flow) in these devices, along with the requirement for larger amplifiers and the possibility of amplifier clipping. And this amount of boost does not fully compensate for the high frequency losses at large off-axis angles!

The net effect of all these compromises in a 3-way design is that for a person seated 30 or more degrees off-axis, there will be extreme high frequency roll off or at least response roughness above about 10 Khz, and a sizeable dip in the midrange. As this dip is in a very important frequency range in terms of both human voice and low overtones of musical instruments, intelligibility of the spoken word and clarity of complex musical passages will suffer noticeably, along with an apparent compression of dynamics in the sound.

Yet another compromise in a 3-way design is the use of cone midrange drivers in the 200 to 2 Khz frequency band. All cone drivers stop acting like pistons above a frequency which is determined by their cone size and stiffness, with larger cones having lower breakup frequencies. To have high sensitivity and power handling, which then translates to high output, relatively large cone midranges are used, in the 6 to 10 inch range. But at this size of cone, this breakup frequency will occur around 1 Khz or lower, resulting in rough frequency response at or above this frequency. There is usually a dip in the frequency response of a cone in the vicinity of this breakup frequency. There will also typically be delayed resonance, where some of the energy emitted from the cone will be delayed in time. These phenomena will also negatively impact clarity and smoothness of response, but will occur at all listening angles from the line.

Still yet another compromise in a 3-way design is that at high sound pressure levels, the relatively wide bandwidth required of the mid frequency drivers means that they will be fed relatively large amounts of power, driving them into non-linear operation. One cause of this is that high power levels will result in relatively large cone excursions, which drive the voice coils out of the linear region of the magnetic field within the voice coil gap. This non-linear operation at wide bandwidth gives rise to higher levels of both harmonic and intermodulation distortion, where sum and difference frequencies of the input frequencies are generated. This is an especially undesirable form of distortion.

There have been many other line arrays introduced since the L'Acoustics VDOSC system, with the majority of them being highly similar in design, and many being simpler two-way systems. Many different methods have been used to achieve a similar uniformity of high frequency coverage in the vertical direction, which we will not be concerned with here. Some of these other systems have symmetric driver layouts, while some have non-symmetric driver layouts. Some have located the midrange drivers behind baffles with slots in them, most notably the JBL VERTEC, as disclosed in U.S. Design Pat. No. D450,778 S, issued to Mark Engebretson on Nov. 20, 2001. The McCauley Monarc line array is possibly the first known to have a cutaway front on it, where the top and bottom boards above and below the high and mid frequency drivers have been removed to reduce undesirable reflections off these surfaces, thereby increasing the vertical uniformity of the sound field. A further example of this type of design is the Nexo box disclosed in U.S. Design Pat. No. D500,025 S, issued to Eric Vincenot on Dec. 21, 2004.

The only known example of a modular, 4-way line array loudspeaker is the Clair Brothers system disclosed in U.S. Pat. No. 6,112,847 issued to Richard W. Lehman on Sep. 5, 2000. This box consists of a single low frequency driver on one end, four direct radiating midrange cone drivers on the other end, four large format mid-high compression drivers in the center feeding horns followed by a diffraction slot, and a multitude of small format high frequency compression drivers feeding horns and a diffraction slot which is centered between the two columns of cone midranges. Thus no two spectrally adjacent sets of drivers are completely physically adjacent, as the low frequency and low mid frequency sets of drivers are on opposite ends of the box, the outer column of low mid cone drivers are separated from the high mid drivers by the high frequency drivers and a second column of low mid drivers, and the high mid drivers are separated from the high frequency drivers by a column of low mid drivers. This may not be apparent from FIG. 1 of the Lehman patent, because the low mid cone drivers are removed for clarity, but is apparent from examination of FIG. 7 of the Lehman patent. Thus optimum differential path length criteria as taught by the present invention is not followed, resulting in an off-axis frequency response that contains multiple, extreme dips and notches, and also particularly bad time alignment between the arrivals of the different spectral components.

It is an object of the present invention to provide a more uniform frequency response to listeners at large off-axis angles to line array systems. It is another object of the present invention to reduce distortion in line array systems. It is yet another object of the present invention to provide higher acoustic output from a line array system. It is still yet another object of the present invention to improve clarity and fidelity from a line array system.

SUMMARY OF THE INVENTION

In accordance with the invention, a line array speaker is provided which, in a symmetrical embodiment, has one or more central apertures from which frequencies in a high frequency band are emitted. The central apertures are straddled by a pair of sets of one or more apertures, one set on each side of the one or more high frequency band apertures. The straddling pair emits frequencies in the next lower frequency band relative to the high frequency band. Sequential additional pairs of sets of one or more apertures saddle immediately preceding pairs of sets, each straddling pair emitting frequencies in a band next lower than the frequencies of the immediately preceding pair.

In another embodiment, the speaker has one or more apertures from which frequencies in a high frequency band are emitted. One or more apertures adjacent the high frequency band apertures emit frequencies in the next lower frequency band relative to the high frequency band. Sequential additional sets of one or more apertures adjacent immediately preceding sets, taken moving away from the high frequency band apertures, each emit frequencies in a band next lower than the frequencies of the immediately preceding set.

Each of the apertures may be a loudspeaker cone, one or more straight slots, one or more arbitrarily curved slots, one or more arbitrarily angled slots, one or more holes or the mouth of a horn.

The speaker may have a front baffle which is a flat panel or multiple facets arranged in one or multiple recesses across a front of the speaker.

Speakers of either embodiment will achieve highly uniform frequency response throughout a wide listening field, while also reducing distortion and improving fidelity, clarity, and output level.

BRIEF DESCRIPTION OF THE DRAWINGS

The present invention will now be described by way of exemplary embodiments to which it is not limited as illustrated in the accompanying drawings, in which:

FIG. 1 is a top and front view of a prior art 3-way line array loudspeaker design;

FIG. 2 is a top and front view of one potential embodiment of the a 4-way line array loudspeaker design incorporating the present invention;

FIG. 3 is a top and front view of a preferred embodiment of a 4-way line array loudspeaker design incorporating the present invention.

DETAILED DESCRIPTION

Figure 4A:
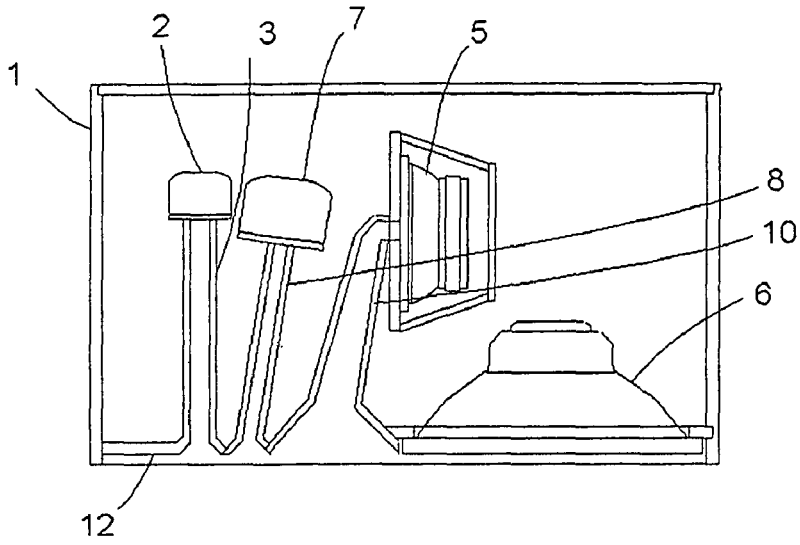
FIG. 4 is a top and front view of another potential embodiment of the 4-way line array loudspeaker design incorporating the present invention.

Because of all the aforementioned limitations and compromises of a 3-way line array design, it is desirable to provide an improved design that overcomes all of the above mentioned problems in the prior art line array systems. FIGS. 1A and 1B show a conventional 3-way design, consisting of an outer enclosure 1, with a front baffle 12, a high frequency driver or drivers 2, mounted on a horn or waveguide 3, or multiple horns or waveguides, which terminate in an aperture or diffraction slot 4, one or more midrange cone drivers 5, and one or more larger, lower frequency cone drivers 6. For a listening position which is at 45 degrees off the forward axis, the differential path length between the two midrange cones is denoted Dm. It is desirable that $Dm<v/(4\times fc1)$, where v is the speed of sound and fc1 is the crossover frequency between the midrange and high frequency drivers. Stated another way, the differential path length is desired to be less that ¼ wavelength at the crossover frequency, to keep the response dip to less than 3 dB. In practice, this differential path length is often ½ wavelength at the crossover frequency, resulting in effective cancellation of the midrange driver's output.

FIGS. 2A and 2B show one embodiment of the current invention, where the midrange drivers 5 have been augmented by a second set of midrange drivers 7, and these different sets of midrange drivers are fed with different frequency bands, forming a 4-way system. The smaller drivers, which are closer to the high frequency source, are fed with a higher frequency band, while the larger drivers, which are further from the higher frequency source, are fed with a next lower frequency band. Since the differential path length Dm1 is now less than the previous 3-way case, the upper crossover point may be increased, decreasing the load on the high frequency drivers, thereby reducing their distortion, or the amount of midband dip at large listening angles may be reduced, or some combination of the two. Also, use of a smaller upper midrange cone pushes up the cone breakup frequency, resulting in improved midrange clarity. Finally, splitting the midrange band into multiple bands results in lower bandwidth and therefore lower power applied to each set of midrange drivers, reducing distortion, or improving midrange headroom, or some combination of the two.

However, this embodiment, while an improvement over the 3-way design in the upper midrange and high frequencies, does not necessarily improve the lower midrange performance, due to the wider spacing required of the lower frequency drivers, or the use of smaller lower midrange drivers.

FIG. 3 shows another embodiment of the current invention, where the midrange drivers have been mounted on horns, tubes, or other such acoustic channels behind the front baffle 12. The upper midrange driver 7 feeds into acoustic channel 8, terminating in aperture or apertures 9, while lower midrange driver 5 feeds into acoustic channel 10, terminating in aperture or apertures 11. Note that these apertures or mouths can be comprised of multiple holes of any shape. This embodiment results in several further improvements. First, the apertures or mouths of the horns can be of smaller horizontal extent than the midrange drivers themselves, allowing said mouths to be located closer together and also reducing the spacing between the outer low frequency drivers, reducing all the differential path lengths within each band and between the bands. It can be seen that both Dm1 and Dm2 have been approximately cut in half from their lengths in FIG. 2, and that Dm2 is now approximately equal to the original Dm of FIG. 1. This means the crossover point from the upper midrange 7 to the high frequency driver 2 can be further increased compared to the embodiment in FIG. 2, and, since the upper crossover point to the lower midrange 5 is now typically ½ the frequency used in a prior art 3-way design, the dip in the midrange response at 45 degrees off axis is now considerably smaller, both in terms of depth and frequency extent.

Second, horn loading of the midranges increases their efficiency, resulting in higher acoustic output, reduced power demands, reduced distortion, or a variety of combinations of these improvements. Third, the upper midrange band or bands may be implemented with specialized compression drivers rather than cone drivers. Since compression drivers have voice coils that are the same diameter as their diaphragms, and these diaphragms are made from much stiffer materials than typical cone drivers, and the size of these diaphragms are typically smaller than the cone of a cone midrange, the breakup frequency is much, much higher than for a cone midrange. Thus piston-like motion of the diaphragm can be maintained far in excess of the crossover frequency to the high frequency driver, and said crossover frequency can be raised if desired, allowing use of small format high frequency devices, with their vastly improved response and dispersion above 10 Khz. These specialized midrange compression drivers typically have diaphragms made from phenolic, which has higher damping and therefore less ringing than metal diaphragms, and have lower resonance frequencies and larger designed excursion capabilities than metal diaphragm drivers, so that they can better handle the lower crossover high-pass frequencies associated with midrange use. Thirdly, the size of the lower band midrange driver can be increased if desired, while keeping the desired spacing between the lower frequency drivers. Lastly, the lower midrange driver can cross over low enough in frequency to remain within it's piston band, enhancing clarity and reducing distortion.

Figure 4B:
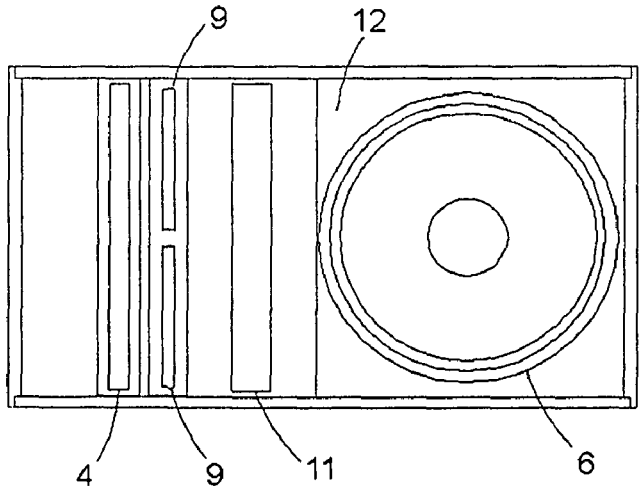

For cost or size reasons, it may be desirable to implement a non-symmetrical, or single-sided embodiment of the current invention. This embodiment is shown in FIG. 4. In this case, the important differential path lengths are between the adjacent frequency bands, where a differential path length greater than ¼ wavelength at frequencies near the crossover point between these adjacent bands will result in excessive dips in the frequency response around these frequencies when listening off-axis. The ordered progression of the physical locations of the multiple frequency bands allows for this minimum differential path length criteria to be met, or exceeded for large off-axis angles.

The present invention has been described by way of a few exemplary embodiments to which it is not limited. Modifications and variations will occur to those skilled in the art without departing from the scope and spirit of the invention.

What is claimed is:

1. A line array speaker comprising:

at least one aperture from which frequencies in a high frequency band are emitted;

a first pair of sets of at least one aperture, one set on each side of said at least one high frequency band aperture, from which frequencies in a first next lower frequency band relative to said high frequency band are emitted;

a second pair of sets of at least one aperture, one set of said second pair on each side of said first pair, from which frequencies in a second next lower frequency band relative to said first next lower frequency band are emitted; and a third pair of sets of at least one aperture, one set of said third pair on each side of said second pair, from which frequencies in a third next lower frequency band relative to said second next lower frequency band are emitted.

2. A line array speaker according to claim 1 further comprising at least one additional pair of sets of at least one aperture, one set of each sequential said at least one additional pair on each side of an immediately preceding one of said pairs, from which frequencies in sequentially next lower frequency bands relative to each immediately preceding one of said bands are emitted.

3. A line array speaker according to claim 1, each of said apertures comprising one of:

a loudspeaker cone;

at least one straight slot;

at least one arbitrarily curved slot;

at least one arbitrarily angled slot;

at least one hole; and a mouth of a horn.

4. A line array speaker according to claim 1 further comprising a front baffle comprising one of:

a flat panel; and multiple facets arranged in one or multiple recesses across a front of the speaker.

* * * * *